United States Patent [19]

Komiyama et al.

[11] 4,091,970

[45] May 30, 1978

[54] PUMP WITH PORUS CERAMIC TUBE

[75] Inventors: Yoshizo Komiyama, Gotenba; Hiromi Nakamura, Fuji; Hiroaki Abe, Numazu, all of Japan

[73] Assignee: Toshiba Kikai Kabushiki Kaisha, Tokyo, Japan

[21] Appl. No.: 795,723

[22] Filed: May 11, 1977

[30] Foreign Application Priority Data

May 20, 1976 Japan ..... 51-58274

[51] Int. Cl.[2] ..... B22D 39/00

[52] U.S. Cl. ..... 222/596; 106/40 R; 106/56; 106/57; 164/316

[58] Field of Search ..... 222/591, 596, 607; 106/40 R, 56, 57; 164/138, 316, 363

[56] References Cited

U.S. PATENT DOCUMENTS

| | | | |
|---|---|---|---|
| 1,595,783 | 8/1926 | Howes | 222/596 X |
| 3,044,499 | 7/1962 | Frevich | 222/591 X |
| 3,049,432 | 8/1962 | Weber | 164/138 X |
| 3,508,940 | 4/1970 | Webb | 106/40 R |
| 3,916,047 | 10/1975 | Niesen | 106/57 X |

*Primary Examiner*—Robert B. Reeves
*Assistant Examiner*—David A. Scherbel
*Attorney, Agent, or Firm*—Koda and Androlia

[57] ABSTRACT

In a pump for use in a hot chamber type die casting machine wherein corrosive molten metal particularly aluminum or alloys thereof is injected into a metal mould through a goose neck shaped passage, a porous ceramic tube having a porosity of 10 to 40% and acting as the goose neck shaped passage is cast in the main body of the pump. The porous ceramic tube comprises sintered zircon or porous graphite.

13 Claims, 8 Drawing Figures

PUMP WITH PORUS CERAMIC TUBE

BACKGROUND OF THE INVENTION

This invention relates to a pump for pressurizing and pouring molten metal into a metal mould of a hot chamber type die casting machine and more particularly to an improved construction of the pump and a goose neck interconnecting the pump and the mould.

In a hot chamber type die casting machine a container for containing molten metal is installed adjacent the die casting machine, the lower end of an injection pump is immersed in the molten metal in the container and the molten metal is injected into the mould by lowering a plunger of the pump.

The hot chamber type die casting machines have been used extensively for die casting metals having relatively low melting points such as zinc, tin and alloys thereof because of their compact construction, ready handling and capability of producing products, having high and uniform quality. However, molten metals having relatively high melting points such as aluminum and alloys thereof corrode almost all metals, and even ceramics, owing to their high activity. Such corrosion not only damage or wear the important elements of the pump but also the components of such elements dissolve in the molten metal and contaminate the composition of the cast products which results in a defect in the cast products called hard spots.

To eliminate this difficulty it has been proposed to line the inner surface of the pump cylinder with a bushing made of ceramic which is resistant to wear and not corrosed by molten metal of aluminum and alloys thereof.

Since the goose neck comprises a tube having curved opposite ends it is impossible to apply a ceramic lining on the inner surface of the goose neck after casting the main body of the pump thereabout. As the molten metal is forced to flow through the goose neck at a high speed the corrosion of the passage by the molten metal is severe with the result that the diameter of the passage increases. For this reason, the life of the goose neck is short. Since the pump and the goose neck are the largest among various component elements of a die casting machine and expensive, their lives are the important factors that determine the life of the pump so that various measures have been proposed for increasing their lives.

According to one proposal the molten metal passage of the goose neck is formed by surrounding a curved tube made of high density ceramic with cast iron which constitute the main body of the pump. With this construction the cast-in ceramic tube which acts as a core is subjected to a strong compressive force when the cast iron cools and contracts. For this reason, it is said that the ceramic tube is reenforced to withstand rupture during use. Actually, however, most of the ceramic tubes are ruptured at the time of casting due to the thermal stress created during the casting and the compressive force created at the time of cooling. Even when the ceramic tubes were not ruptured during casting, during the operation of the die casting machine they are contacted by high temperature molten metal which is at about 600° C in the case of aluminum or its alloy so that the ceramic tube and the main body of the pump made of cast iron undergo thermal expansion. However, due to the difference in the thermal expansion coefficients, a gap will be formed between the ceramic tube and the main body of the pump so that the ceramic tube would be ruptured due to a high internal pressure of 200 to 300 kg/cm$^2$ which is created at the time of injecting the molten metal. Although it has been proposed to preheat the ceramic tube for the purpose of alleviating the heat shock occurring at the time of casting, it is impossible to prevent rupture of the ceramic tube due to a strong compressive force caused by the difference in the thermal expansion coefficients of the ceramic and cast iron in the same manner as a schrincage fit. Although it is possible to alleviate the heat shock and the compressive force when heat insulating material is wrapped about the ceramic tube, during the operation of the die casting machine thermal expansion occurs with the result that a gap is created between the ceramic tube and the cast iron due to the difference in the thermal expansion coefficients so that the ceramic tube would be ruptured due to the high internal pressure of the molten metal.

SUMMARY OF THE INVENTION

Accordingly, it is an object of this invention to provide a pump for use in a hot chamber type die casting machine which is provided with a goose neck having a porous ceramic tube which is not corroded by molten metal and not ruptured by a high pressure created by the molten metal at the time of operation of the die casting machine.

Another object of this invention is to provide an improved pump for use in a hot chamber type die casting machine wherein the cylinder of the pump is resilienty held to withstand a high injection pressure.

According to this invention there is provided a pump for use in a hot chamber type die casting machine of the type wherein the cylinder of the pump is immersed in molten metal and the molten metal in the cylinder is injected into a metal mould by a plunger operating in the cylinder through a goose neck shaped passage, characterized in that a porous ceramic tube acting as the goose neck shaped passage is cast in the main body of the pump.

DESCRIPTION OF THE PREFERRED EMBODIMENTS

Figure 1:
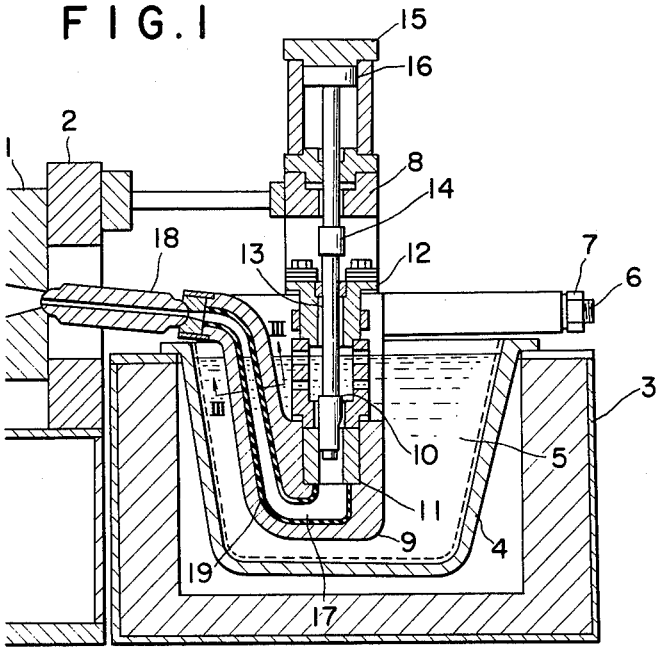
FIG. 1 is a longitudinal sectional view showing a hot chamber type die casting machine incorporated with the pump embodying the invention.

As shown in FIG. 1, near the stationary support 2 of the metal mould of a die casting machine is disposed a furnace 3, and a crucible 4 is disposed in the furnace 3 for containing molten metal 5. Although not shown in the drawing, the crucible is provided with heating means for maintaining the molten metal 5 at a predetermined temperature such as an electric heater or a gas burner. A frame 8 is secured by nuts 7 to two tie bars 6 (only one is shown) extending through the central portion of one side of the stationary support 2. The main body of the pump 9 is supported by frame 8 with almost all of the portions of the main body immersed in the molten metal 5. As shown by dotted lines a protective layer made of refractory material resistant to corrosion may be provided to cover the inner surface of the crucible.

A cylinder 11 adapted to slidably receive a plunger 10 is secured to the main body 9 of the pump by a clamping member 12. The plunger 10 is connected to the piston 16 of an oil pressure cylinder 15 via a shaft 13 and a coupling 14. Accordingly, as the piston 16 descends, the plunger 10 forces the molten metal in cylinder 11 and a passage 17 in the main body into the metal mould 1 via a nozzle 18. Then, when the piston 16 is raised, the plunger is restored to the position shown in FIG. 1 thus completing one cycle of injection.

According to this invention a preformed porous ceramic tube 19 is provided for the goose neck to act as the passage for the molten metal where the molten metal flows at a high speed so that corrosion is the severest. If desired, similar ceramic tube may be provided for the nozzle 18. The ceramic tube 19 may be made of any porous ceramic resistant to corrosion. It is advantageous to fabricate the tube from sintered zircon ($ZrO_2.SiO_2$) having a porosity of from 10 to 40%. Such ceramic has larger resistance to heat shock, better workability and can be moulded more readily than high density ceramics. When a ceramic tube having a suitable porosity is used, pressure is applied not only from the inside but also from the outside of the tube when a high pressure is applied to the molten metal by descending the plunger because a portion of the molten metal permeates the porous ceramic tube. If the porosity is too, high excess quantity of the molten metal oozes to the outside of the ceramic tube thus corroding the cast iron surrounding the same. The porosity of the order of 10 to 40% is selected by taking into considerations such factors as the heat shock at the time of casting, and the fact that a tube having complicated configuration can readily be prepared by casting relatively inexpensive sludge.

Figure 3:
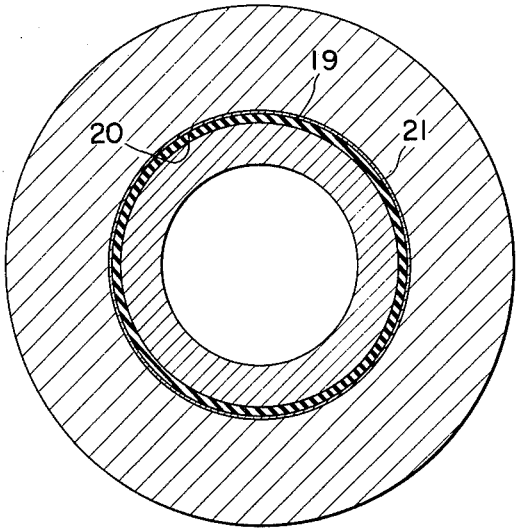
FIG. 3 is a corss-sectional view of the goose neck taken along a line III—III shown in FIG. 3.
Figure 2:
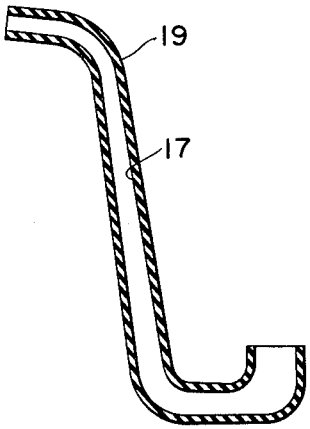
FIG. 2 shows a longitudinal section of a porous ceramic tube constituting a goose neck passage.

After a long run of a pump incorporated with the porous ceramic tube described above the goose neck was cut and the cross-section thereof is shown in FIG. 3. When the iron content of the molten aluminum is less than 0.5% by weight, the activity of the molten metal increases but in the experiment described above the iron content of the molten aluminum was selected to 0.3% by weight, and a running time of 500 hours was selected.

The molten metal permeates through micropores in the ceramic tube 19 to reach the inner wall 20 of the cast iron surrounding the ceramic tube 19. However, an extremely thin film 21 was formed on the inner wall 20 by the reaction between the cast iron and the molten metal. In the experiment described above, the thickness of the film 21 was 0.7 mm. This thin film is one of the features of this invention and each time the plunger 14 is lowered, pressure is transmitted to the inner wall 20 via the micropores in the ceramic tube 19. Although the molten metal contained in the pores of the porous ceramic having a porosity of 10 to 40% may be exchanged with fresh molten metal, the molten metal contained in the micropores on the outer periphery of the ceramic tube would not be exchanged with fresh molten metal, so that the film 21 initially formed on the inner wall of the cast iron will not grow or be replenished. Consequently, the inner wall 20 of the case iron is perfectly protected against the corrosion of the molten metal. The film 21 does not grow since it is saturated by containing a large quantity of iron thus greatly decreasing the activity of the molten metal. Although lower porosity is desirable from the standpoint of corroding the cast iron, the porosity of less than 10% increases the manufacturing cost of the ceramic tube and decreases machinability and the resistance to heat shock.

Even when a gap is formed during operation between the ceramic tube and the cast iron due to the difference in the thermal expansion coefficients, the pressure in the porous ceramic tube is transmitted to the outside thereof through the micropores so that the outer surface of the ceramic tube will also be subjected to pressure thus preventing the rupture of the ceramic tube due to inside pressure.

In addition to the sintered zircon described above, the porous ceramic tube can also be made of other porous ceramic material, for example ceramic glass fibers bonded with a liquid ceramic binder, and porous graphite. A specific ceramic is selected depending upon the size of the pump and the machinability of the ceramic tube.

The portions of the porous ceramic tube where the flow speed of the molten metal is high or where the thermal shock is large can be coated or bonded with ceramic fibers bonded with a liquid binder.

It is advantageous to construct the plunger 10 and the inner wall of the pump with ceramic having high resistance to corrosion and high resistance to wear.

Figure 4:
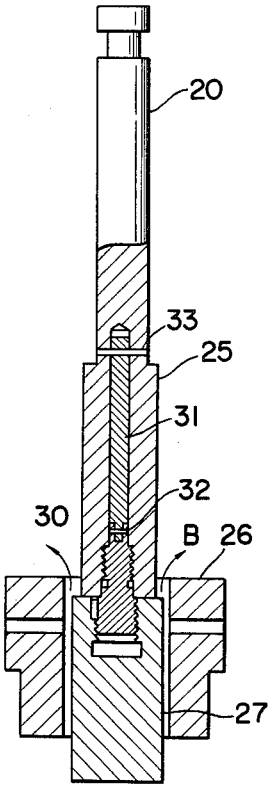
FIGS. 4 and 5 are longitudinal sectional views showing modified pump plungers.
Figure 5:
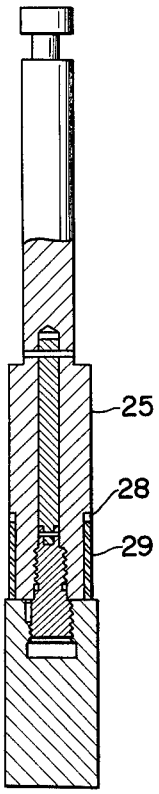

FIGS. 4 and 5 show modified pump plungers.

In FIG. 4 the outer surface of the plunger shaft 25 is coated with zirconia type ceramic which is applied by spraying molten ceramic for preventing corrosion caused by the molten metal. When a plunger head 20 is lowered molten metal flows upwardly as shown by arrows B through the gap between cylinder 26 and plunger head 27 and along the outer surface of the plunger shaft 25 thus damaging the same. Especially in a pump to be used over a long time, a protected sleeve 29 made of ceramic is fitted over the plunger shaft 25 with a packing 28 interposed therebetween as shown in FIG. 5. In both embodiments, the plunger head 27 is connected to plunger rod 20 through threaded shaft 30, and a shaft 31 which are contained in plunger shaft 25. The lower end of shaft 31 is connected to shaft 30 by a pin 32 while the upper end is connected to plunger rod 20 by a transverse pin 33 which is located at a position not to be immersed in the molten metal when the plunger is lowered. With this construction, shafts 30 and 31 and pin 32 are protected against the corrosion caused by the molten metal.

Figure 6:
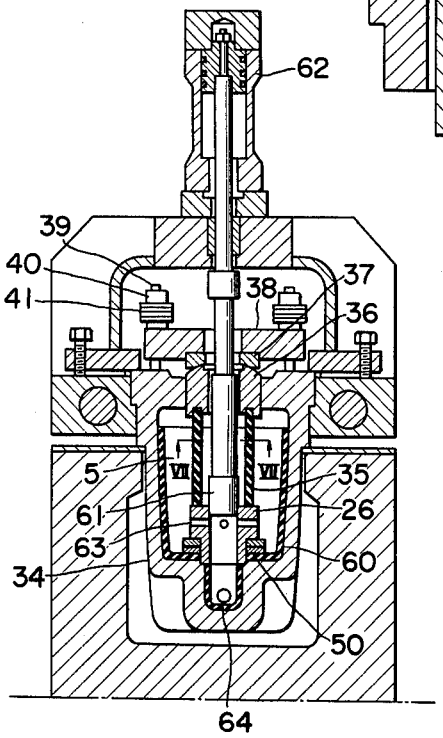
FIG. 6 is a transversal sectional view showing a modified pump.
Figure 7:
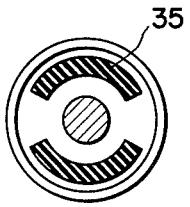
FIG. 7 is a cross-sectional view of the pump shown in FIG. 6 taken along a line VII—VII.

FIG. 6 shows a modified construction of the cylinder 26 shown in FIGS. 4 and 5. In this embodiment, cylinder 26 is urged against the bottom of the mainbody of the pump 34 through a bushing 35, a short cylindrical member 36, a ring 37, a pressing plate 38, bolts 39, nuts 40 and dish washers 41. As shown in FIG. 7, the bushing 35 is provided with slots 37' on both sides to allow molten metal 5 to freely flow into the inside of the bushing 35. This construction prevents thermal unbalance of the molten metal. The bushing 35 is made of ceramics having high rigidity and mechanical strength and is resitant to corrosion caused by the molten metal such as silicon nitride $Si_3N_4$, silicon carbide SiC and a composite composition of silicon nitride, silicon carbide and alumina $Al_2O_3$. A lining 60 made of similar material is applied to the inner surface of the main body 34 which in this embodiment corresponds to the crucible 4 shown in FIG. 1. The plunger 61 is actuated by a piston-cylinder assembly 62. The molten metal flows into the cylinder 26 through a plurality of transverse openings 63 and injected into the metal mould through the goose neck (see FIG. 1) and an opening 64. Furthermore, instead of using dish washers 41 the pressing plate 38 may be resiliently urged by a plurality of piston-cylinder assemblies (not shown) which are installed at the position of bolts 39. As shown in FIG. 6 a packing 50 comprising a lamination of sheets of flexible graphite, or boron nitride BN a lamination of felts or inorganic fibers, such as zircon or zirconia is interposed between the bottom of the cylinder 26 and the main body 34 of the pump. When the molten metal is pressed by the plunger 61 its pressure rises to 200 atmospheric pressures, for example, so that it is necessary to clamp the packing 50 at a higher pressure, 400 atmospheric pressures, for example.

Figure 8:
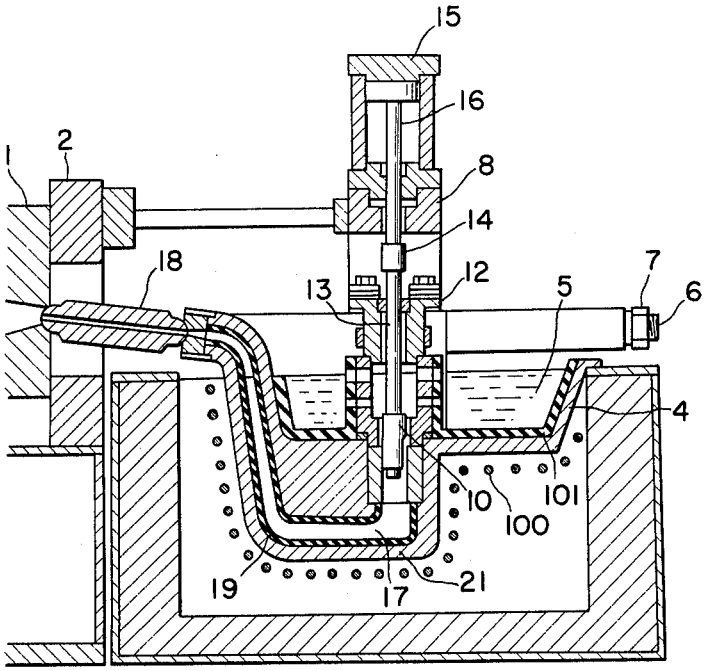
FIG. 8 is a longitudinal cross-sectional view showing a modification of this invention.

In another embodiment shown in FIG. 8, the goose neck, the main body of the pump and the crucible 4 are made integral for the purpose of decreasing the inner surface area of the crucible to be protected against corrosion. The construction of the goose neck containing the porous ceramic tube 19 is the same as that shown in FIG. 1. An electric heating unit 100 is provided beneath the crucible 4 and the goose neck for maintaining the molten metal at a constant temperature. A refractory lining 101 is applied to the inner surface of the crucible 4. The lining 101 is made of material not corroded by molten aluminum, for example refractory brick, alumina cement, aluminum phosphate cement, zirconia cement, a refractory and castable refractory which is generally called a plastic refractory and has plasticity at the time of application. Such lining can be formed by bonding bricks or by integral moulding. When compared with the embodiment shown in FIG. 1, this modification is advantageous in that, as the main body of the pump and the goose neck are not in contact with the molten metal, it is not necessary to apply protective coatings thereon.

We claim:

1. In a pump for use in a hot chamber type die casting machine of the type wherein the cylinder of the pump is immersed in molten metal and the molten metal in the cylinder is injected into a metal mould by a plunger operating in the cylinder through a main body constituting a goose neck shaped passage, the improvment which comprises a ceramic tube which is porous to molten metal which is cast in said main body of said pump and constitutes said goose neck shaped passage.

2. The pump according to claim 1 wherein said porous ceramic tube has a porosity of from 10 to 40%.

3. The pump according to claim 1 wherein said porous ceramic tube is made of sintered zircon.

4. The pump according to claim 1 wherein said porous ceramic tube comprises porous graphite.

5. The pump according to claim 1 wherein said porous ceramic tube comprises ceramic fibers bonded with a binder.

6. The pump according to claim 1 wherein said plunger comprises a plunger head, a plunger shaft and a threaded shaft contained in said plunger shaft for connecting said plunger head to said plunger shaft, the upper end of said threaded shaft being secured to said plunger shaft by a transverse pin located at a position not immersed in the molten metal when the plunger is lowered in the cylinder.

7. The pump according to claim 6 wherein the outer surface of said plunger shaft is protected by a ceramic sheath.

8. The pump according to claim 1 which further comprises a packing made of a lamination of sheets of inorganic material and interposed between the bottom of said cylinder and the main body of the pump and means for resiliently urging said cylinder against said packing.

9. The pump according to claim 8 wherein a hollow bushing is interposed between said cylinder and said urging means to surround said plunger, and said bushing is provided with lateral openings to permit the molten metal to flow into the inside of said bushing.

10. The pump according to claim 1 wherein said cylinder is provided with at least one lateral opening at a position below the lower end of the plunger when it is raised for filling the interior of the cylinder with the molten metal.

11. The pump according to claim 1 wherein the molten metal is contained in a container lined with a refractory lining.

12. The pump according to claim 1 wherein a container of the molten metal and the goose neck shaped passage are formed as an integral cast body and a lining of refractory is applied to cover the inner surface of the container.

13. The pump according to claim 1 wherein said container is provided with heating means for maintaining the temperature of the molten metal at a predetermined temperature.

* * * * *